US011116376B2

(12) United States Patent
Tsai et al.

(10) Patent No.: US 11,116,376 B2
(45) Date of Patent: Sep. 14, 2021

(54) VACUUM CLEANER SYSTEM

(71) Applicant: Quanta Computer Inc., Taoyuan (TW)

(72) Inventors: Sheng-An Tsai, Taoyuan (TW); Lu-Lung Tsao, Taoyuan (TW); Yu-Ching Tsai, Taoyuan (TW)

(73) Assignee: QUANTA COMPUTER INC., Taoyuan (TW)

( * ) Notice: Subject to any disclaimer, the term of this patent is extended or adjusted under 35 U.S.C. 154(b) by 313 days.

(21) Appl. No.: 16/360,322

(22) Filed: Mar. 21, 2019

(65) Prior Publication Data

US 2020/0196815 A1 Jun. 25, 2020

(30) Foreign Application Priority Data

Dec. 19, 2018 (TW) ..... 107145997

(51) Int. Cl.
*A47L 9/28* (2006.01)

(52) U.S. Cl.
CPC ..... *A47L 9/2873* (2013.01); *A47L 2201/02* (2013.01); *A47L 2201/04* (2013.01); *A47L 2201/06* (2013.01)

(58) Field of Classification Search
CPC ..... A47L 2201/02; A47L 2201/022; A47L 2201/04; A47L 2201/06; A47L 9/009; A47L 9/2873
See application file for complete search history.

(56) References Cited

U.S. PATENT DOCUMENTS

2015/0115876 A1* 4/2015 Noh ..... H02J 7/0042 320/107

FOREIGN PATENT DOCUMENTS

| | | | | |
|---|---|---|---|---|
| CN | 201469183 U | * | 5/2010 | |
| CN | 201469183 U | | 5/2010 | |
| CN | 202821218 U | * | 3/2013 | |
| CN | 104257330 A | * | 1/2015 | |
| CN | 104586320 A | * | 5/2015 | ..... H02J 7/0042 |
| CN | 105011865 A | * | 11/2015 | |
| CN | 206611777 U | | 11/2017 | |
| CN | 206850071 U | * | 1/2018 | |
| CN | 207691541 U | * | 8/2018 | |
| KR | 20100024099 A | * | 3/2010 | |
| TW | I607733 B | * | 12/2017 | |
| TW | I607733 B | | 12/2017 | |

OTHER PUBLICATIONS

TW-I607733-B—English Machine Translation (Year: 2017).*

* cited by examiner

*Primary Examiner* — Marc Carlson
(74) *Attorney, Agent, or Firm* — Rabin & Berdo, P.C.

(57) ABSTRACT

A vacuum cleaner system includes a docking station and a mobile vacuum cleaner. The docking station includes a charging stand and a parking plate. The parking plate is connected to the charging stand, and formed with two position-limiting slots. The mobile vacuum cleaner includes a working machine body and two transmission wheels. The transmission wheels are rotatably arranged on the working machine body for traveling the working machine body. When the transmission wheels are moved into the position-limiting slots, respectively, the mobile vacuum cleaner presses the parking plate by a gravity of the mobile vacuum cleaner through the two transmission wheels.

8 Claims, 8 Drawing Sheets

VACUUM CLEANER SYSTEM

RELATED APPLICATIONS

This application claims priority to Taiwan Application Ser. No. 107145997, filed Dec. 19, 2018, which is herein incorporated by reference.

BACKGROUND

Field of Disclosure

The disclosure relates to a vacuum cleaner system. More particularly, the disclosure relates to a vacuum cleaner system that improves return success rates of a vacuum sweeping machine.

Description of Related Art

With the development of science technology, a vacuum sweeping machine is provided in the industry to automatically move around and clean by itself so as to reduce the frequency of clean work by human. After cleaning, the vacuum sweeping machine can automatically return to a docking station for charging and parking.

However, the location where a docking station of the conventional vacuum sweeping machine being chosen at home is subject to many environmental restrictions, for example, the docking station must be placed to lean directly against the wall or other solid side, or is unable to be placed horizontally on an uneven floor or a soft blanket. Accordingly, when an inappropriate location is selected for the docking station, the vacuum sweeping machine cannot return the docking station accurately, and reduce the success rates of the vacuum sweeping machine returning to the docking station. Also, the energy consumption caused by repeated attempts to return to the docking station will reduce the overall efficiency of the vacuum sweeping machine.

SUMMARY

In one embodiment of the disclosure, a vacuum cleaner system is provided. The vacuum cleaner system includes a docking station and a mobile vacuum cleaner. The docking station includes a charging stand and a parking plate. The parking plate is connected to the charging stand, and formed with two position-limiting slots. The mobile vacuum cleaner includes a working machine body and two transmission wheels. The transmission wheels are rotatably arranged on the working machine body for traveling the working machine body. Thus, when the working machine body is moved on the parking plate to place the transmission wheels in the position-limiting slots, respectively, the mobile vacuum cleaner presses the parking plate by a gravity of the mobile vacuum cleaner through the two transmission wheels.

According to one or more embodiments of the disclosure, in the vacuum cleaner system, the charging stand includes at least one first electric contact, and the mobile vacuum cleaner includes at least one second electric contact. When the transmission wheels of the mobile vacuum cleaner are moved into the position-limiting slots, respectively, the second electric contact of the mobile vacuum cleaner is in contact with the first electric contact of the charging stand.

According to one or more embodiments of the disclosure, in the vacuum cleaner system, the docking station further includes at least one confirmation element, and the confirmation element is disposed on the parking plate. The mobile vacuum cleaner further includes a control unit and a sensing device. The control unit is electrically connected to the sensing device for controlling the motion of the transmission wheels. When the sensing device is not triggered by the confirmation element in a period of time, the control unit controls the transmission wheels to move the mobile vacuum cleaner away from the docking station. When the sensing device is triggered by the confirmation element, the control unit controls the transmission wheels to remain stay on the docking station.

According to one or more embodiments of the disclosure, in the vacuum cleaner system, the confirmation element is disposed on a top surface of the parking plate, and the sensing device is disposed on a bottom surface of the working machine body.

According to one or more embodiments of the disclosure, in the vacuum cleaner system, the confirmation element is disposed in one of the position-limiting slots, and the sensing device is disposed on one of the transmission wheels.

According to one or more embodiments of the disclosure, in the vacuum cleaner system, each of the position-limiting slots includes a plurality of guiding slopes and a sunken area. The guiding slopes surround the sunken area. Each of the guiding slopes is respectively connected to the sunken area and a top surface of the parking plate.

According to one or more embodiments of the disclosure, in the vacuum cleaner system, the mobile vacuum cleaner is completely on a top surface of the parking plate.

According to one or more embodiments of the disclosure, in the vacuum cleaner system, the charging stand is detachably coupled to a top surface of the parking plate.

According to one or more embodiments of the disclosure, in the vacuum cleaner system, the parking plate includes an inclined surface adjoining a top surface of the parking plate, and the top surface is a flat surface.

According to one or more embodiments of the disclosure, in the vacuum cleaner system, the parking plate further comprises a plurality of protrusions. The protrusions are protrudingly formed on a top surface of the parking plate to define the two position-limiting slots.

Thus, through the construction of the embodiments above, since the location where a docking station being chosen is no longer restricted by the environment, the mobile vacuum cleaner can be returned to the docking station accurately, therefore, the success rates of the mobile vacuum cleaner returning to the docking station can be effectively improved, thereby, achieving the purpose of improving efficiency and energy saving.

The above description is merely used for illustrating the problems to be resolved, the technical methods for resolving the problems and their efficacies, etc. The specific details of the disclosure will be explained in the embodiments below and related drawings.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure. In the drawings.

DESCRIPTION OF THE EMBODIMENTS

Figure 1:
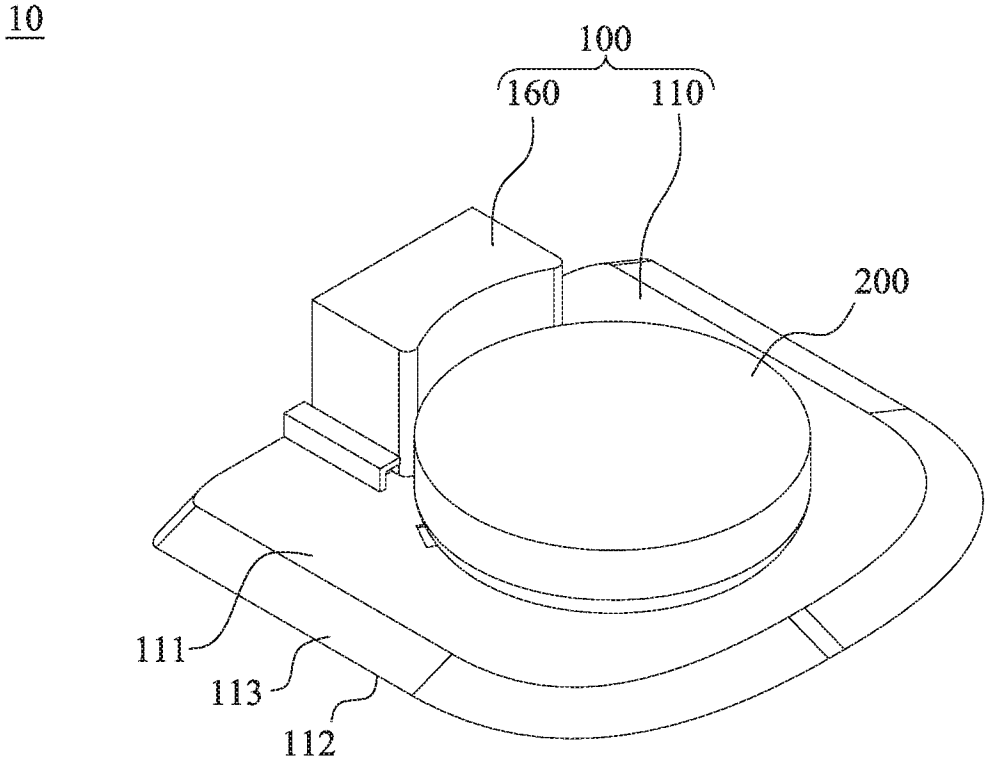
FIG. 1 is a perspective view of a vacuum cleaner system according to one embodiment of the disclosure.

Reference will now be made in detail to the present embodiments of the disclosure, examples of which are illustrated in the accompanying drawings. Wherever possible, the same reference numbers are used in the drawings and the description to refer to the same or like parts. According to the embodiments, it will be apparent to those skilled in the art that various modifications and variations can be made to the structure of the disclosure without departing from the scope or spirit of the disclosure.

Figure 2:
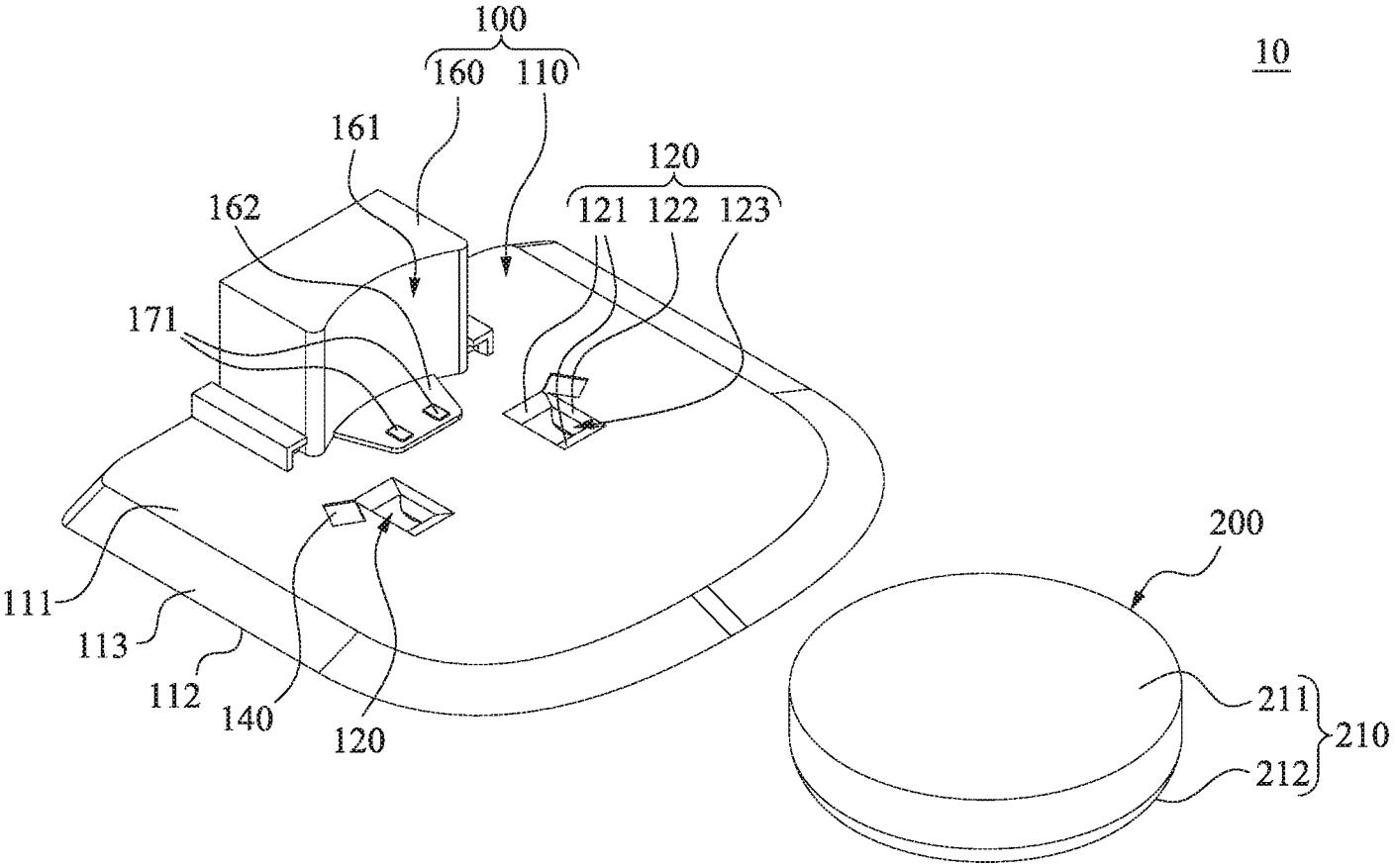
FIG. 2 is a schematic view of the mobile vacuum cleaner of FIG. 1 not parked at the docking station yet.
Figure 3:
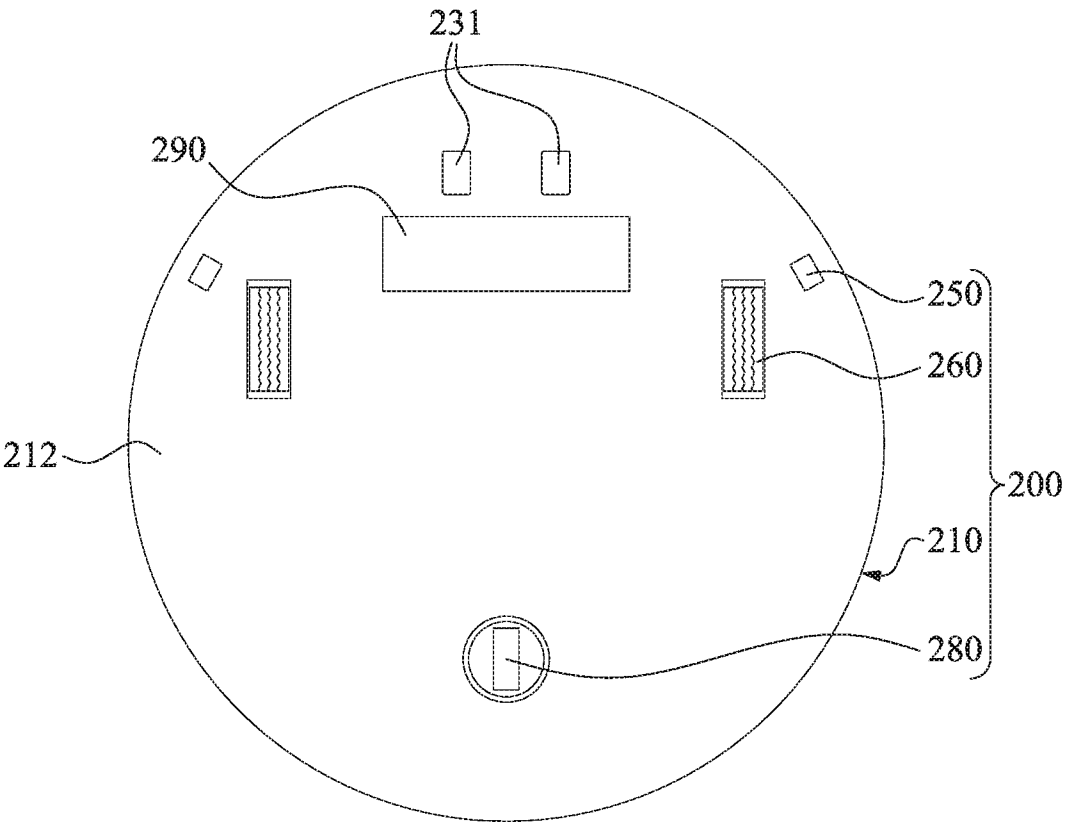
FIG. 3 is a bottom view of the mobile vacuum cleaner of FIG. 1.

Reference is now made to FIG. 1 to FIG. 3, in which FIG. 1 is a perspective view of a vacuum cleaner system 10 according to one embodiment of the disclosure, FIG. 2 is a schematic view of the mobile vacuum cleaner 200 of FIG. 1 not parked at the docking station 100 yet, and FIG. 3 is a bottom view of the mobile vacuum cleaner 200 of FIG. 1. As shown in FIG. 1 to FIG. 3, the vacuum cleaner system 10 includes a docking station 100 and a mobile vacuum cleaner 200. The docking station 100 includes a parking plate 110 and a charging stand 160. The parking plate 110 allows the mobile vacuum cleaner 200 to be parked thereon. The parking plate 110 includes a top surface 111, a bottom surface 112, an inclined surface 113 and two position-limiting slots 120.

The top surface 111 and the bottom surface 112 are located oppositely, and the inclined surface 113 is disposed between the top surface 111 and the bottom surface 112. The parking plate 110 is used to be placed on a loading surface (e.g., ground surface) so that the bottom surface 112 of the parking plate 110 is physically contacted with the loading surface. The top surface 111 can be, for example, a flat surface or a hard surface, however, the disclosure is not limited thereto. The charging stand 160 is connected to the parking plate 110. Exemplarily, the charging stand 160 is fixedly coupled to the top surface 111 of the parking plate 110.

The mobile vacuum cleaner 200 includes a working machine body 210, two transmission wheels 260 and a steering wheel 280. The working machine body 210 includes a top surface 211 and a bottom surface 212 which are opposite to each other. The working machine body 210 is formed with a dust suction opening 290 located on the bottom surface 212 of the working machine body 210. The transmission wheels 260 are rotatably disposed on the working machine body 210 for traveling the working machine body 210 around so as to enable the working machine body 210 to perform the cleaning operation through the dust suction opening 290. Exemplarily, the transmission wheels 260 are rotatably disposed on the bottom surface 212 of the working machine body 210. The steering wheel 280 is rotatably disposed on the working machine body 210 for steering the working machine body 210. For example, the steering wheel 280 is rotatably disposed on the bottom surface 212 of the working machine body 210. Thus, when the mobile vacuum cleaner 200 is docked to the docking station 100, the transmission wheels 260 of the mobile vacuum cleaner 200 climb to the top surface 111 of the parking plate 110 from the aforementioned loading surface through the slope surface 113 first, then, fall into the position-limiting slots 120 from the top surface 111 of the parking plate 110 respectively so as to finish the returning procedure.

In the present embodiment, the mobile vacuum cleaner 200 is completely on a top surface 111 of the parking plate 110, that is, the outline of the mobile vacuum cleaner 200 is totally located within the range of the top surface 111 of the parking plate 110. However, the disclosure is not limited to that the mobile vacuum cleaner 200 has to be totally located within the range of the top surface 111 of the parking plate 110.

Thus, with the structure of the above embodiment, when the mobile vacuum cleaner 200 is docked to the docking station 100, since the mobile vacuum cleaner 200 presses the parking plate 110 onto the loading surface by its own gravity through the transmission wheels 260, the charging stand 160 will not be knocked down or deviated by the mobile vacuum cleaner 200. Therefore, the docking station 100 is not needed to set its arrangement position by leaning against a wall surface or other solid side surface, thereby overcoming the placing limit of the docking station 100.

In addition, since the mobile vacuum cleaner 200 can complete the returning procedure mentioned above by standing on the top surface 111 of the parking plate 110, the mobile vacuum cleaner 200 will not be affected by any uneven or soft material floor. Accordingly, the placement location of the docking station 100 is no longer restricted by any environment. Therefore, the mobile vacuum cleaner 200 can be returned to the docking station 100 accurately, therefore, the success rates of the mobile vacuum cleaner 200 returning to the docking station 100 can be effectively improved, thereby, achieving the purpose of improving efficiency and energy saving.

Figure 4:
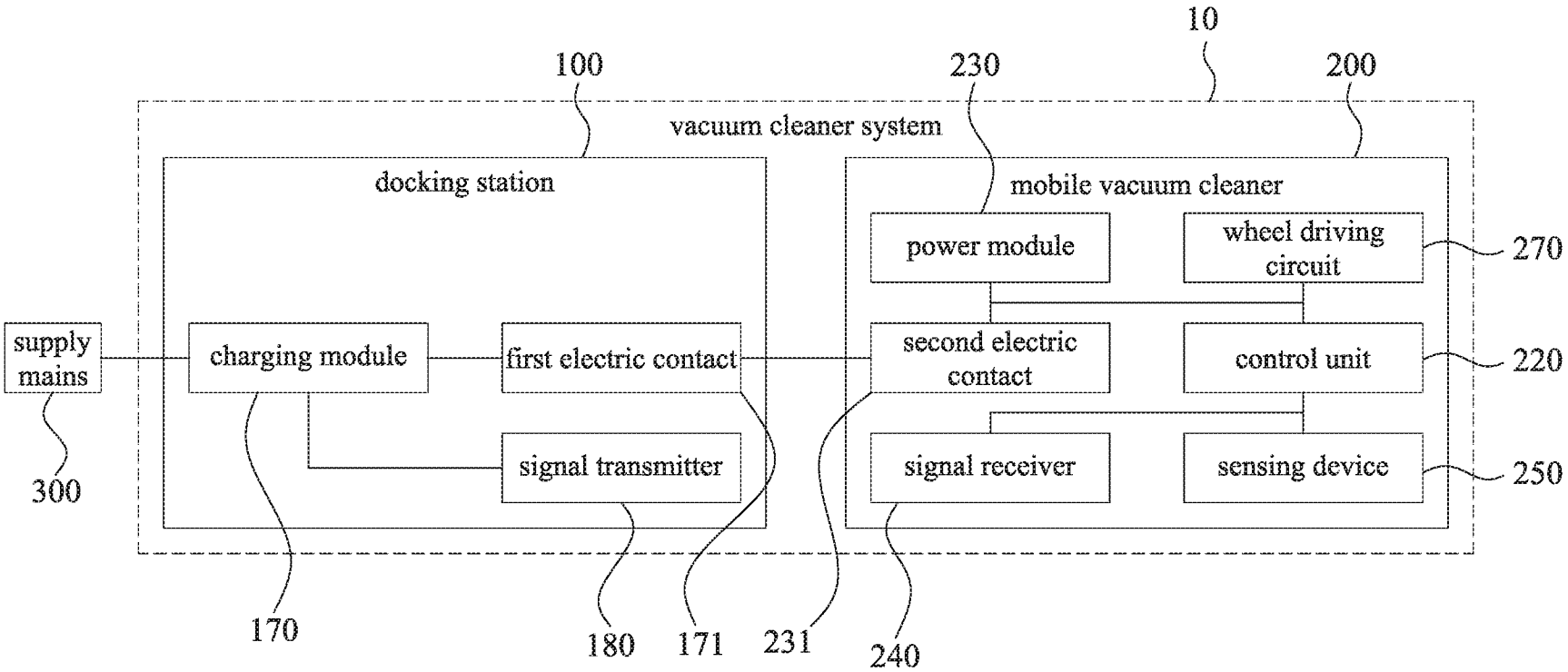
FIG. 4 is an electrical block diagram of the vacuum cleaner system of FIG. 1.

FIG. 4 is an electrical block diagram of the vacuum cleaner system 10 of FIG. 1. More specifically, as shown in FIG. 2 and FIG. 4, the charging stand 160 is formed with an indentation portion 161 and an outer protrusive plate 162. The indentation portion 161 is located on one side of the charging stand 160 facing towards the position-limiting slots 120, and the outer protrusive plate 162 is located within the indentation portion 161, and connected to the side of the charging stand 160. The charging stand 160 further includes a charging module 170 and two first electric contacts 171. The charging module 170 is located inside the charging stand 160 and electrically connected to the first electric contacts 171. The first electric contacts 171 are exposed outwards from a surface of the charging stand 160. More specifically, the first electric contacts 171 are located on a surface of the outer protrusive plate 162.

As shown in FIG. 3 and FIG. 4, the mobile vacuum cleaner 200 further includes a control unit 220, a power module 230 and a wheel driving circuit 270. The control unit 220, the power module 230 and the wheel driving circuit 270 are respectively disposed in the working machine body 210.

The wheel driving circuit 270 is used to drive the transmission wheels 260 and the steering wheel 280 described above to work. The control unit 220 is disposed in the working machine body 210, and electrically connected to the wheel driving circuit 270 and the power module 230 for controlling the transmission wheels 260 and the steering wheel 280 through the wheel driving circuit 270. The power module 230 is electrically connected to the control unit 220 and the wheel driving circuit 270 for providing required supply power to the control unit 220 and the wheel driving circuit 270. The power module 230 includes two second electric contacts 231. The second electric contacts 231 are exposed outwards from the bottom surface 212 of the working machine body 210.

Therefore, when the transmission wheels 260 of the mobile vacuum cleaner 200 are respectively fallen into the position-limiting slots 120, with the intendedly arrangement of the first electric contacts 171 and the second electric contacts 231 in advance, the second electric contacts 231 of the mobile vacuum cleaner 200 can be accurately contacted with the first electric contact 171 of the charging stand 160 for ensuring the quality of the electrical connection. Thus, the charging module 170 is able to charge the power module 230 through the first electric contact 171 and the second electric contact 231 which are in contact with each other. More specifically, the charging module 170 transmits supply power from the mains 300 to the power module 230 for charging the power module 230 via the first electric contacts 171 and the second electric contacts 231 being in contact with each other.

Since the position-limiting slots 120 have been prearranged at specific positions of the parking plate 110 intendedly, as long as the transmission wheels 260 are able to be moved into the position-limiting slots 120 respectively, the second electric contacts 231 of the mobile vacuum cleaner 200 can be ensured to be contacted with the first electric contacts 171 of the charging stand 160. Therefore, the mobile vacuum cleaner 200 can be returned to the docking station 100 accurately, thereby ensuring that the second electric contacts 231 contact with the first electric contacts 171 more efficiently.

In addition, since the transmission wheels 260 of the mobile vacuum cleaner 200 are fallen into the position-limiting slots 120 to press the charging stand 160 with its own gravity, the second electric contacts 231 of the mobile vacuum cleaner 200 can more closely contact with the first electric contacts 171 of the charging stand 160, thereby improving the power, thereby, increasing electrical connection quality.

The docking station 100 further includes a signal transmitter 180. The signal transmitter 180 is disposed in the charging stand 160 for intermittently transmitting a intention signal. However, the disclosure is not limited thereto, and the signal transmitter may also be located in the parking plate. The docking station 100 further includes two confirmation elements 140. The confirmation elements 140 are disposed on the parking plate 110, e.g., disposed at the top surface 111 of the parking plate 110, and are adjacent to the position of the position-limiting slots 120. The mobile vacuum cleaner 200 further includes a signal receiver 240 and two sensing devices 250. The signal receiver 240 is located in the working machine body 210, and is electrically connected to the power module 230 and the control unit 220 for receiving the intention signal sent by the signal transmitter 180. The sensing devices 250 are oppositely disposed on the working machine body 210, and exposed from the bottom surface 212 of the working machine body 210 adjacent to the transmission wheels 260. The sensing devices 250 are further electrically connected to the control unit 220 for being triggered by any of the confirmation elements 140. The power module 230 is electrically connected to the sensing devices 250 and the signal receiver 240 for providing required supply power to the sensing devices 250 and the signal receiver 240.

When the mobile vacuum cleaner 200 receives an instruction of the returning procedure, the control unit 220 starts to detect the intention signal through the signal receiver 240, and the mobile vacuum cleaner 200 is moved to the docking station 100 according to the intention signal for repeatedly attempting to return to the docking station 100.

When the mobile vacuum cleaner 200 is traveled on the tope surface 111 of the parking plate 110, and when the sensing devices 250 are not triggered by the confirmation elements 140 in a period of time, the control unit 220 controls the transmission wheels 260 loading the working machine body 210 to move away from the docking station 100 so as to attempt return to the docking station 100. On the other hand, when the mobile vacuum cleaner 200 is traveled on the tope surface 111 of the parking plate 110, and the sensing devices 250 are triggered by the confirmation elements 140, the control unit 220 controls the transmission wheels 260 loading the working machine body 210 to remain stay on the docking station 100.

It is noted, when the transmission wheels 260 of the mobile vacuum cleaner 200 are fallen into the position-limiting slots 120, and the sensing devices 250 are triggered by the confirmation elements 140, by intendedly arranging the confirmation elements 140 and the sensing devices 250 in advance, the second electric contacts 231 of the mobile vacuum cleaner 200 can be exactly contacted with the first electric contacts 171 of the charging stand 160, respectively.

Although the confirmation elements 140 in the above embodiment are arranged on the top surface 111 of the parking plate 110, and the sensing devices 250 are arranged on the bottom surface 212 of the working machine bod 210, however, the disclosure is not limited thereto, as long as the second electric contacts 231 are able to be exactly contacted with the first electric contacts 171, in other embodiments, the person having ordinary skills in the art may also select to set the confirmation elements 140 in the position-limiting slots 120, and the sensing devices 250 on the transmission wheels 260 so that the sensing devices 250 can be triggered by the confirmation elements 140 in the position-limiting slots 120.

For example but not to be limited, each of the sensing devices 250 is an optical transceiver, for example, a reflective infrared transceiver or a visible light transceiver. Each of the confirmation elements 140 is an optical control surface. The optical control surface, for example, can be an absorbed/reflective material or has a light deflecting/refractive surface. Specifically, each of the confirmation elements 140 includes a black light-absorbing coating layer. As the black light-absorbing coating layer can avoid reflecting lights outwardly, the sensing devices 250 cannot receive any reflective light from the confirmation elements 140, accordingly, the sensing devices 250 are programed to be triggered by the confirmation elements 140.

Figure 5A:
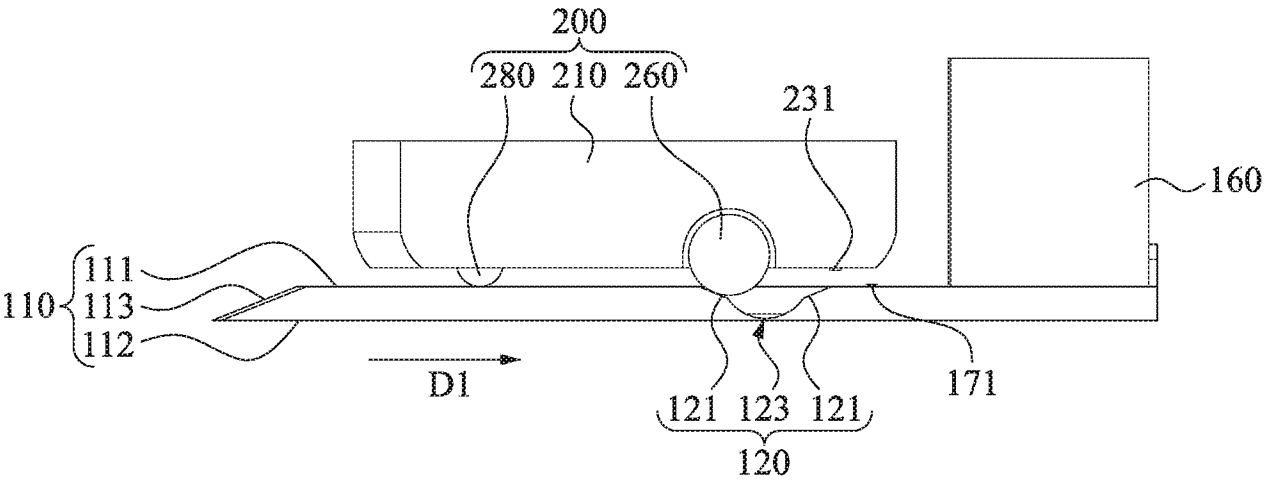
FIG. 5A-FIG. 5B are continuous schematic views expressing the transmission wheels of the mobile vacuum cleaner fallen into the position-limiting slots of the docking station in a first direction.
Figure 5B:
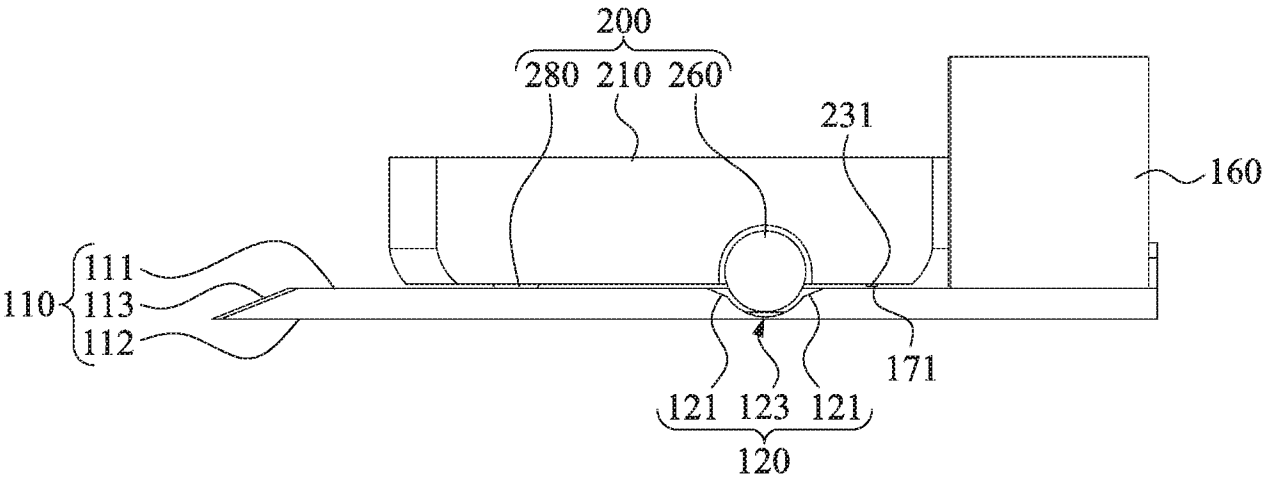

FIG. 5A-FIG. 5B are continuous schematic views expressing the transmission wheels 260 of the mobile vacuum cleaner 200 fallen into the position-limiting slots 120 of the docking station in a first direction D1. As shown in FIG. 2, FIG. 5A and FIG. 5B, in this embodiment, each of the position-limiting slots 120 includes a sunken area 123 and one or more guiding slopes surround the sunken area 123. The guiding slopes, for example, include two first guiding slopes 121 and two second guiding slopes 122. The first guiding slopes 121 are arranged opposite to each other, and the second guiding slopes 122 are arranged opposite to each other, and the sunken area 123 is located between the first guiding slopes 121 and between the second guiding slopes 122. Therefore, the first guiding slopes 121 and the second guiding slopes 122 collectively surround the sunken area 123. Each of the first guiding slopes 121 is respectively connected to the sunken area 123 and the top surface 111 of the parking plate 110, and each of the second guiding slopes 122 is respectively connected to the sunken area 123 and the top surface 111 of the parking plate 110.

Thus, when the mobile vacuum cleaner 200 climbs to the top surface 111 of the parking plate 110 along the first direction D1, as long as the transmission wheels 260 are moved to one of the first guiding slopes 121, with the guiding of the first guiding slopes 121, the transmission wheels 260 will be smoothly fallen into the recessed area 123 along the first direction D1 so as to assist the mobile vacuum cleaner 200 to return to the docking station 100 successfully.

Figure 6A:
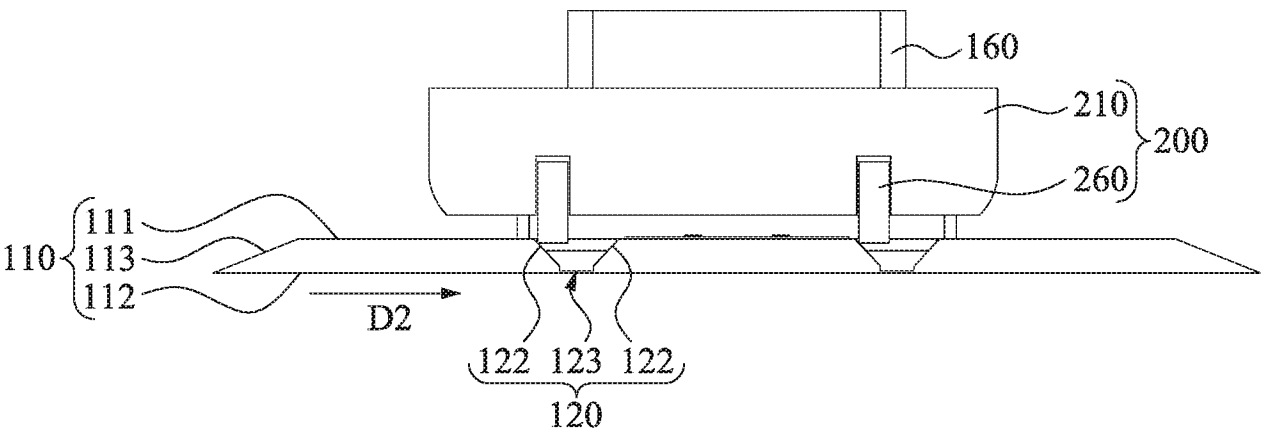
FIG. 6A-FIG. 6B are continuous schematic views expressing the transmission wheels of the mobile vacuum cleaner fallen into the position-limiting slots of the docking station in a second direction.
Figure 6B:
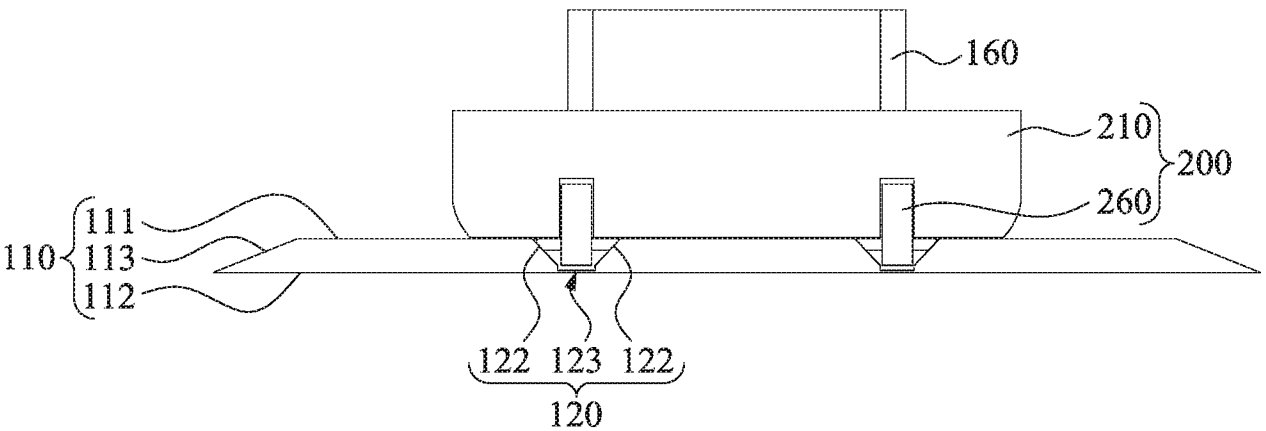

FIG. 6A-FIG. 6B are continuous schematic views expressing the transmission wheels 260 of the mobile vacuum cleaner 200 fallen into the position-limiting slots 120 of the docking station 100 in a second direction D2. As shown in FIG. 2, FIG. 6A and FIG. 6B, in this embodiment, when the mobile vacuum cleaner 200 is wandered on the top surface 111 of the parking plate 110, but still has not fallen into the position-limiting slots 120 yet, as long as one of the transmission wheels 260 is moved to one of the second guiding slopes 122, with the guiding of the second guiding slopes 122, the transmission wheels 260 will be smoothly fallen into the recessed area 123 along the second direction D2 so as to assist the mobile vacuum cleaner 200 to return to the docking station 100 successfully.

Figure 7:
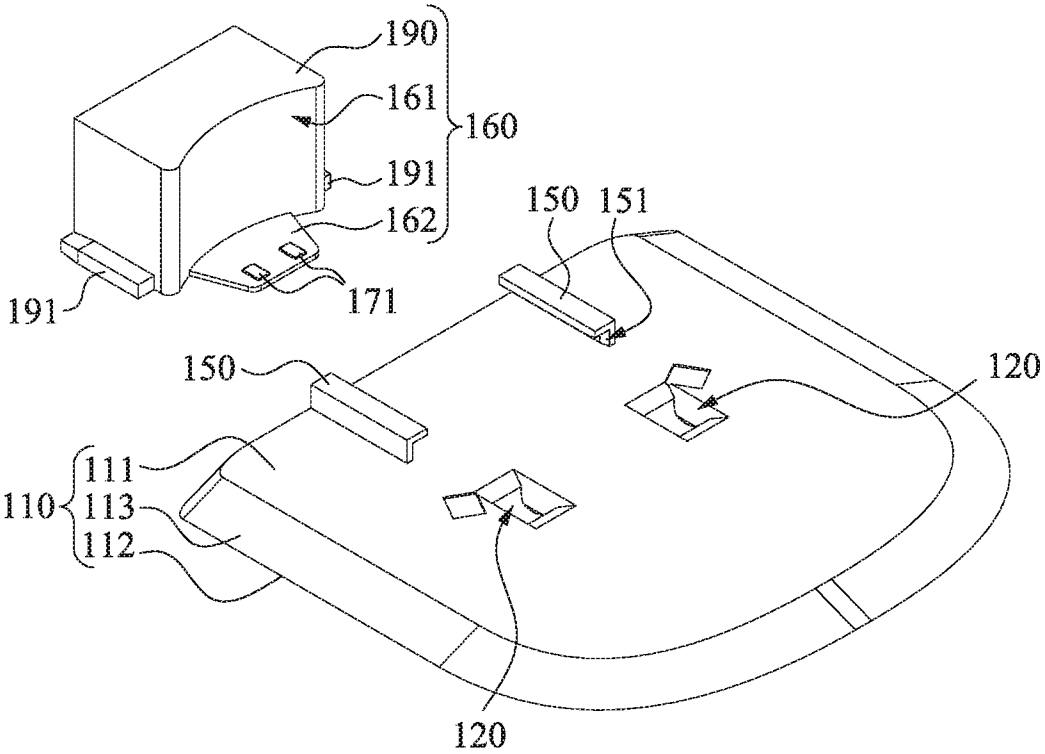
FIG. 7 is a disassembled view of the docking station of FIG. 1.

FIG. 7 is a disassembled view of the docking station 100 of FIG. 1. As shown in FIG. 7, in the embodiment, the charging stand 160 is detachably coupled to the top surface 111 of the parking plate 110. More specifically, the charging stand 160 includes a base 190 and two sliding rails 191 located on opposite sides of the base 190. The parking plate 110 includes two ribs 150 which are oppositely formed on the top surface 111 of the parking plate 110. Each of the ribs 150 has a sliding groove 151, and the two sliding groove 151 are respectively formed on two facing sides of the ribs 150. Thus, during assembly, the sliding rails 191 are respectively slid into the sliding slots 151, so that the base 190 of the charging base 160 can be fixedly assembled to the ribs 150 of the parking plate 110.

However, the disclosure is not limited thereto, as long as the charging stand 160 can be fixedly connected to the parking plate 110, in other embodiments, the person having ordinary skills in the art may also select the screwing fixing manner to assemble the charging stand 160 to the top surface 111 of the parking plate 110.

Figure 8:
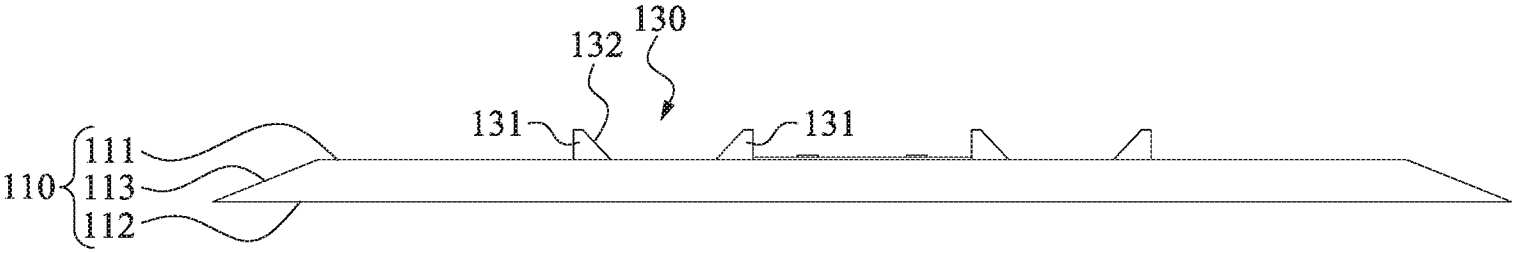
FIG. 8 is a schematic view of a docking station of a vacuum cleaner system according to one embodiment of the disclosure.

FIG. 8 is a schematic view of a docking station 100 of a vacuum cleaner system 10 according to one embodiment of the disclosure. As shown in FIG. 8, in the embodiment, the position-limiting slots 130 of FIG. 8 and the position-limiting slots 120 of FIG. 2 are substantially the same, however, at least some differences of the docking station of FIG. 8 from that in FIG. 2 are that, the position-limiting slots 120 of FIG. 2 is concavely formed on the top surface 111 of the parking plate 110 toward the inside of the parking plate 110, however, the parking plate 110 of FIG. 8 is provided with a plurality of protrusions 131. The protrusions 131 are protrudingly formed on the top surface 111 of the parking plate 110 to define the position-limiting slots 130 for replacing the position-limiting slots 120 of FIG. 2. One surface of each of the protrusions 131 facing towards the position-limiting slot 130 is formed a third first guiding slope 132 for guiding the mobile vacuum cleaner to fall into the position-limiting slot 130.

Although the disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A vacuum cleaner system, comprising:

a docking station, comprising a charging stand, a parking plate connected to the charging stand and formed with two position-limiting slots, and at least one confirmation element disposed in one of the two position-limiting slots; and a mobile vacuum cleaner, comprising a working machine body, two transmission wheels rotatably arranged on the working machine body for traveling the working machine body, a sensing device disposed on one of the two transmission wheels, and a control unit electrically connected to the sensing device for controlling the motion of the two transmission wheels, wherein, when the working machine body is moved on the parking plate to respectively place the two transmission wheels in the two position-limiting slots, and the sensing device is triggered by the confirmation element, the mobile vacuum cleaner presses the parking plate by a gravity of the mobile vacuum cleaner through the two transmission wheels, and when the sensing device is triggered by the confirmation element, the control unit controls the two transmission wheels to stay on the docking station.

2. The vacuum cleaner system of claim 1, wherein the charging stand comprising at least one first electric contact, and the mobile vacuum cleaner comprising at least one second electric contact, wherein, when the two transmission wheels of the mobile vacuum cleaner are moved into the two position-limiting slots, respectively, the at least one second electric contact of the mobile vacuum cleaner is in contact with the at least one first electric contact of the charging stand.

3. The vacuum cleaner system of claim 2, wherein when the sensing device is not triggered by the confirmation element in a period of time, the control unit controls the two transmission wheels to move the mobile vacuum cleaner away from the docking station.

4. The vacuum cleaner system of claim 1, wherein each of the two position-limiting slots comprises a plurality of guiding slopes and a sunken area, the guiding slopes surrounds the sunken area, and each of the guiding slopes is respectively connected to the sunken area and a top surface of the parking plate.

5. The vacuum cleaner system of claim 1, wherein the mobile vacuum cleaner is completely on a top surface of the parking plate.

6. The vacuum cleaner system of claim 1, wherein the charging stand is detachably coupled to a top surface of the parking plate.

7. The vacuum cleaner system of claim 1, wherein the parking plate comprises an inclined surface adjoining a top surface of the parking plate, and the top surface is a flat surface.

8. The vacuum cleaner system of claim 1, wherein the parking plate further comprises a plurality of protrusions, the protrusions are protrudingly formed on a top surface of the parking plate to define the two position-limiting slots.

* * * * *